United States Patent [19]

Clearwater

[11] 4,251,913

[45] Feb. 24, 1981

[54] APPARATUS FOR FEEDING SLIDE FASTENER CHAIN WITH FOLDING OF ATTACHED ARTICLE MEMBER

[75] Inventor: Russell A. Clearwater, Delevan, N.Y.

[73] Assignee: Textron, Inc., Providence, R.I.

[21] Appl. No.: 48,333

[22] Filed: Jun. 14, 1979

[51] Int. Cl.[3] ..... A41H 43/02

[52] U.S. Cl. ..... 29/766; 226/68

[58] Field of Search ..... 29/408, 766; 226/67, 226/68, 88

[56] References Cited

U.S. PATENT DOCUMENTS

| | | | |
|---|---|---|---|
| 2,444,706 | 7/1948 | Loew | 226/68 |
| 2,593,585 | 4/1952 | Madgwick et al. | 226/68 |
| 2,709,587 | 5/1955 | Meyers | 226/68 |

*Primary Examiner*—Lowell A. Larson

*Attorney, Agent, or Firm*—O'Brien & Marks

[57] ABSTRACT

An apparatus for simultaneously feeding a slide fastener chain and folding back article members attached to an outer edge portion of one or both tapes of the slide fastener chain includes a pawl arrangement slidably mounted in a first elongated member for engaging and advancing fastening elements of the slide fastener chain retained in a channel formed between the first elongated member and a second elongated member. A guide is attached to one of the first and second elongated members for folding the article members back as the slide fastener chain is advanced.

6 Claims, 12 Drawing Figures

AIR
VALVE
STAPLE, GAP AND / OR CUT OFF
24
20
112
52
70
110
44
42
40
48
22
25
3
2

30
26
25
32

32
26
30

10
52
6
20
68
70
5
11
12
94
92
90
48
40
22

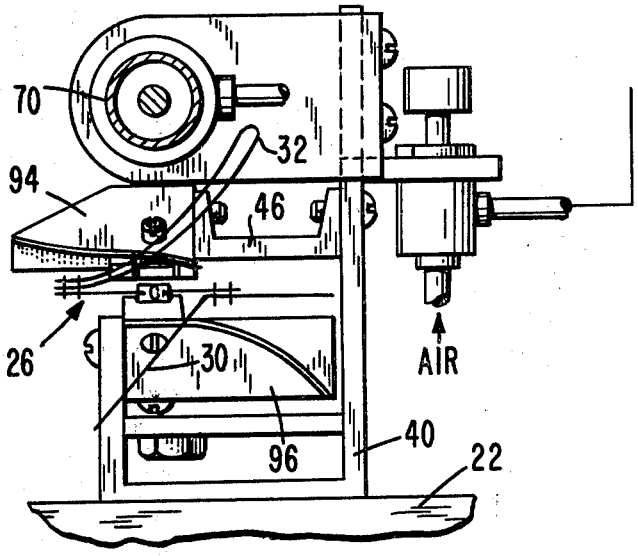
FIG.5
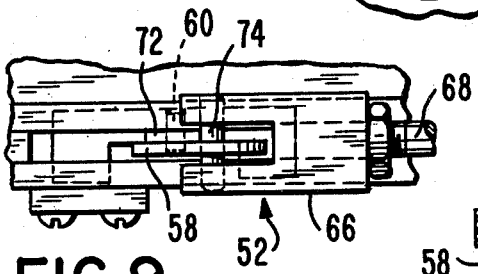
FIG.9
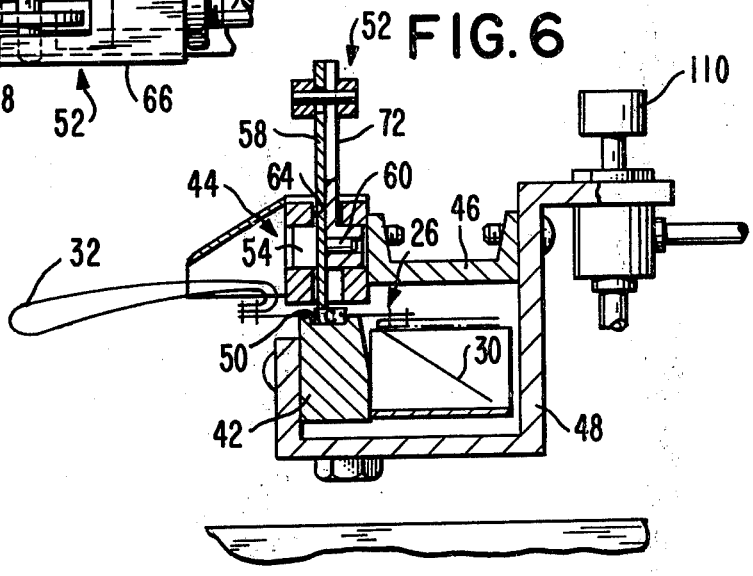
FIG.6
FIG.7
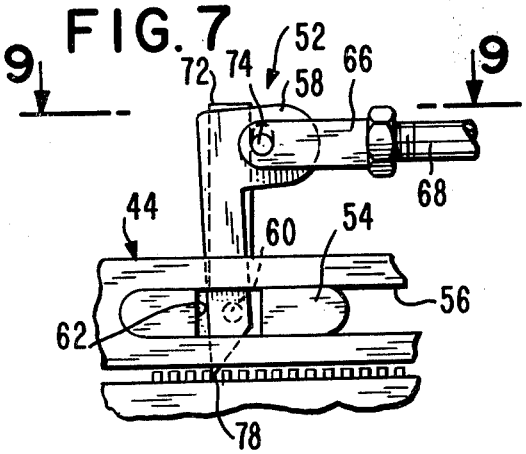
FIG.8
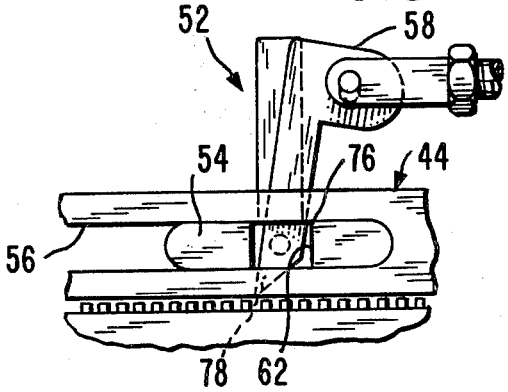

FIG. 10
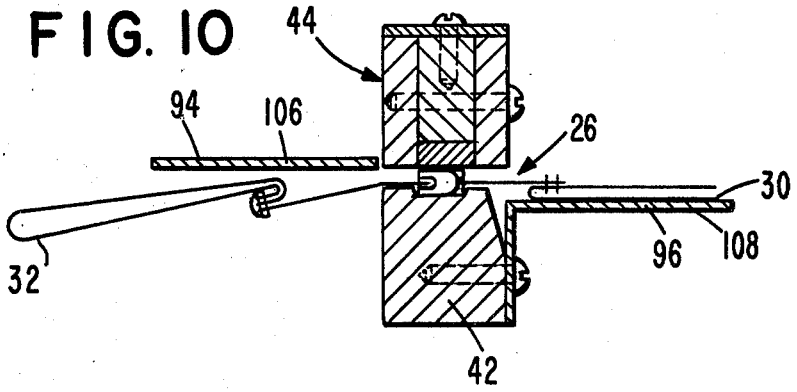
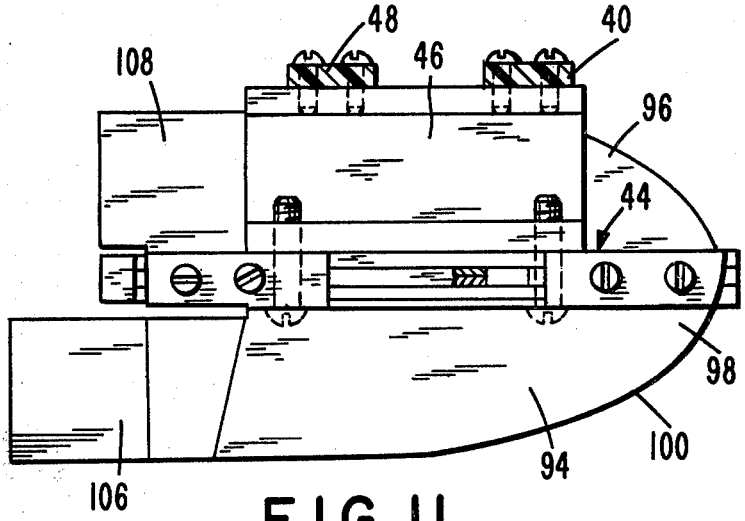
FIG. 11
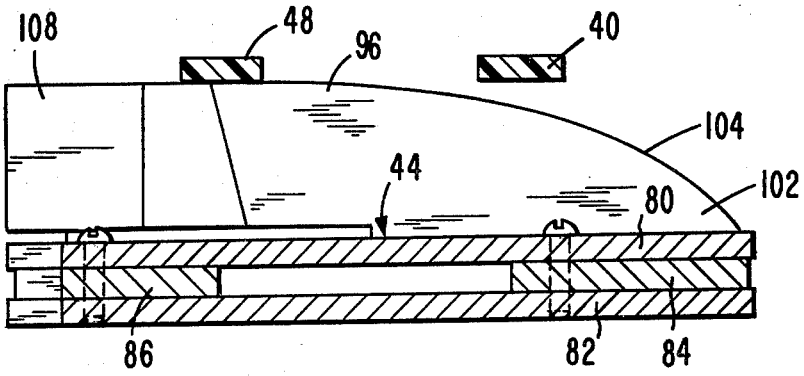
FIG. 12

APPARATUS FOR FEEDING SLIDE FASTENER CHAIN WITH FOLDING OF ATTACHED ARTICLE MEMBER

TECHNICAL FIELD

The present invention relates to an apparatus for feeding a slide fastener chain having article members such as fly pieces or the like attached to one or both sides thereof into a subsequent operating mechanism such as a cutter, gapper, stapler, etc., wherein the article members are folded back.

DESCRIPTION OF THE PRIOR ART

The prior art, as exemplified in U.S. Pat. No. 2,885,774 and No. 3,570,104, contains automatic apparatus for forming slide fasteners with attached article members or fly pieces wherein the article members are folded back prior to gapping and cutting the slide fastener chain. Such automatic apparatus is relatively complicated and expensive, and in manufacturing operations where relatively small quantities of slide fasteners with attached article members are required, the expense of such automatic equipment is not warranted. In such smaller manufacturing operations, the slide fastener chain with attached article members is usually positioned manually within stapling, gapping and/or cut-off machines; the article members may require manual folding back during the positioning of the slide fastener chain. Generally, these stapling, gapping and/or cut-off mechanisms employ presses and the operator's hands must be removed from the press area during operation of the mechanism. The operator must then grasp the slide fastener chain and reposition the slide fastener chain with the article member or members folded back for the next operation. In smaller prior art manufacturing operations, the folding back of the article members and the positioning of the slide fastener chain requires the operator to produce a relatively large amount of hand movement to grasp the end of the continuous slide fastener chain and pull the slide fastener chain.

SUMMARY OF THE INVENTION

The invention is summarized in an apparatus for feeding a slide fastener chain which has interlocking fastening elements secured on inner edges of respective tapes of a pair of tapes of the slide fastener chain, and for folding an article member secured on an outer edge portion of one of the tapes and extending over the fastening elements of the slide fastener chain, the apparatus including an upper elongated guide member, a lower elongated guide member extending parallel to the upper guide member, the upper and lower guide members having channel means forming a feed path therebetween for receiving and guiding the interlocking fastening elements, pawl means slidably mounted on one of the upper and lower guide members for engaging a fastening element of the fastening elements on the slide fastener chain and for moving the slide fastener chain along the feed path, a folding member mounted on one of the upper and lower guide members and having a forward tapered tip disposed adjacent to an entrance end of one of the upper and lower guide members for engaging the article member on a surface facing the one tape, and the folding member having an outer edge which extends outward and rearward along the tapered tip, and parallel to the guide members from the tapered tip rearward to fold and hold the article members away from the fastening elements.

An object of the invention is to construct an apparatus to aid an operator in manually positioning a slide fastener chain with attached article members in an operating mechanism for performing one or more of the operations of stapling, gapping, cutting off, etc.

Another object of the invention is to present a section of slide fastener chain with its article member or members folded back in position for being easily grasped by the operator for positioning in an operating mechanism.

One advantage of the invention is that operator hand movement and fatigue is reduced, enabling increased production.

One of the features of the invention is that an end of a section of slide fastener chain to be operated on is fed with its article member or members folded back to a position where the operator can easily grasp the section of slide fastener chain and, with minimum hand movement, position the section of slide fastener chain in the mechanism for operating on the slide fastener chain.

Other objects, advantages and features of the invention will be apparent from the following description of the preferred embodiment taken in conjunction with the accompanying drawings.

BRIEF DESCRIPTION OF THE DRAWINGS

FIG. 5 is an elevational cross-section view taken at line 5—5 in FIG. 4.

FIG. 6 is an elevational cross-section view taken at line 6—6 in FIG. 4.

FIG. 7 is a side elevational view of a pawl mechanism broken away from the apparatus of FIG. 4 and in an advanced position during the feeding of the slide fastener chain.

FIG. 8 is a view similar to FIG. 7, but with the pawl mechanism in a retracted position.

FIG. 9 is a plan view of the pawl mechanism taken at line 9—9 of FIG. 7.

FIG. 10 is an elevational cross-section view taken at line 10—10 in FIG. 4.

FIG. 11 is a horizontal cross-section view taken at line 11—11 in FIG. 4.

FIG. 12 is a horizontal cross-sectional view taken at line 12—12 in FIG. 4.

DESCRIPTION OF THE PREFERRED EMBODIMENT

Figure 1:
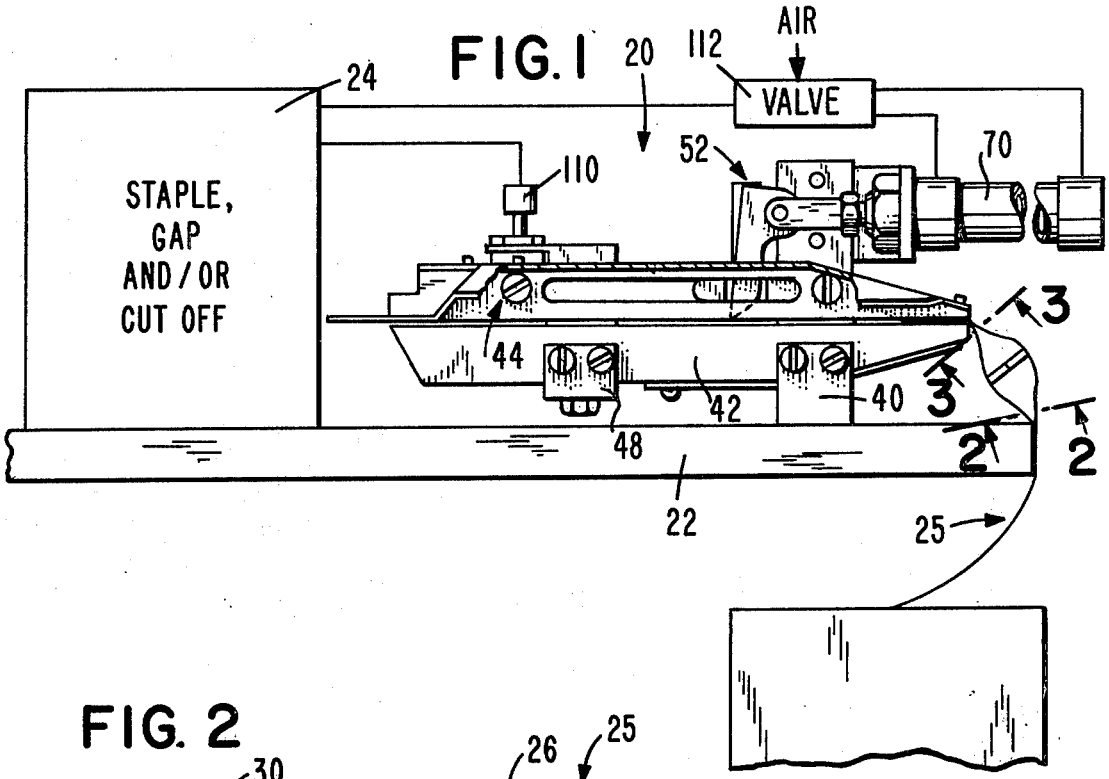
FIG. 1 is an elevational view taken from the left side of an apparatus in accordance with the invention wherein one portion of the apparatus is broken away and a conventional operating mechanism is illustrated as a block.
Figure 2:
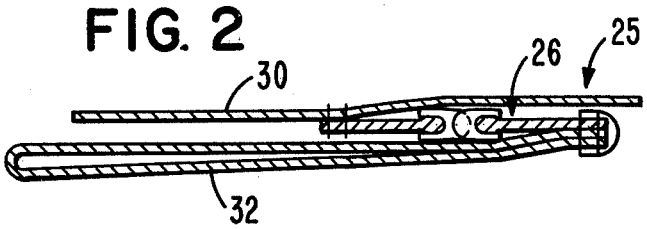
FIG. 2 is a cross-sectional view taken at line 2—2 in FIG. 1 of a slide fastener chain with fly pieces for being operated on by the apparatus of FIG. 1.
Figure 3:
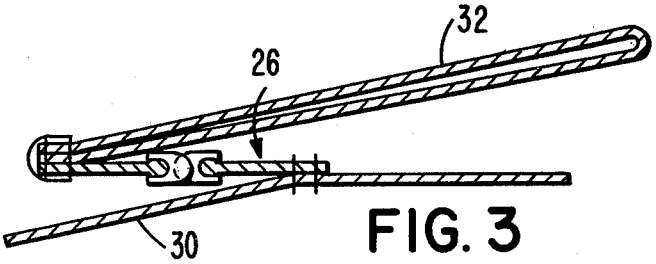
FIG. 3 is a cross-sectional view taken at line 3—3 in FIG. 1 of the slide fastener chain of FIG. 2.

As illustrated in FIG. 1, an embodiment of the invention includes a feeding and folding mechanism or apparatus indicated generally at 20 and mounted on a tabletop 22 directly in front of a conventional operating mechanism 24, such as a stapling, gapping, and/or cut-off mechanism, for performing an operation on an article indicated generally at 25 which includes a slide fastener chain indicated generally at 26 in FIGS. 2 and 3. The slide fastener chain 26 is a conventional continuous slide fastener chain of indefinite length and has a plurality of closely spaced single thickness article members or fly pieces 30 sewn to an outer edge portion of one tape of the slide fastener with a corresponding plurality of double thickness article members or fly pieces 32 sewn to an outer edge portion of the opposite tape with the fly pieces 30 and 32 extended over the fastening elements of the slide fastener chain. The feeding and folding mechanism 20 will also operate on slide fastener chains which have only article members 30 or only article members 32 attached thereto or will operate where one or both of the article members 30 and 32 are continuous lengths of material rather than being segments of cloth.

As shown in FIGS. 1, 4, 5 and 6, the apparatus 20 has a forward bracket 40 secured to the table top 22 and supporting a lower elongated member 42 along with an upper elongated member indicated generally at 44; the upper elongated member 44 is fastened on one side of a channel member 46 which has its other side fastened to the bracket 40. A rear bracket 48 is fastened to the lower elongated member 42 and the channel member 46 for aiding in holding the lower elongated member 42 and the upper elongated member 44 in parallel closely spaced positions to allow the tapes of the slide fastener chain to pass freely therebetween. Channel means is formed between the elongated guide members 42 and 44 throughout the length thereof for receiving and guiding the interlocking fastening elements of the slide fastener chain along a feed path from the front or entrance end of the apparatus to the rear or exit end of the apparatus; such channel means being specifically illustrated as a channel 50 formed in the upper surface of the lower member 42.

A pawl mechanism indicated generally at 52 is slidably mounted in the upper guide member 44 for engaging fastening elements of the slide fastener chain to feed the slide fastener chain. As shown in FIGS. 6, 7, 8 and 9, the pawl mechanism 52 includes a block 54 which is slidable within a horizontal elongated slot 56 in a central portion of the upper elongated member 44. A pawl 58 is pivoted at 60 within a notch 62 in the block 54 and extends through a vertical elongated slot 64 formed in the upper guide member 44. The upper end of the pawl 58 is pivotally attached to a clevis 66 mounted on a piston rod 68 of an air cylinder 70, FIGS. 4 and 5, which is suitably mounted on the bracket 40. A post 72 extends upward from the sliding block 54 through the slot 64 parallel to the pawl 58 for being engaged by the pivot pin 74 of the clevis 58 when the piston rod 68 is advancing to move the sliding block 54 and pawl 58 in a forward direction and to limit the forward pivoting movement of the pawl 58. The sliding block 54 has a shoulder 76 on the notch 62 for engaging the pawl 58 to limit pivoting movement of the pawl 58 during retraction of the piston rod as shown in FIG. 8. A lower tip or point 78 is formed on the pawl 58 to engage the fastening elements of the slide fastener chain when the pawl 58 is pivoted forward as shown in FIG. 7 and to disengage the tip 78 from the fastening elements when the pawl 58 is retracted as shown in FIG. 8.

Conveniently the upper elongated member 44 is formed from a pair of spaced bars 80 and 82 with spacer members 84 and 86 holding the bars 80 and 82 spaced apart at the front and rear ends, respectively, as shown in FIG. 12.

Figure 4:
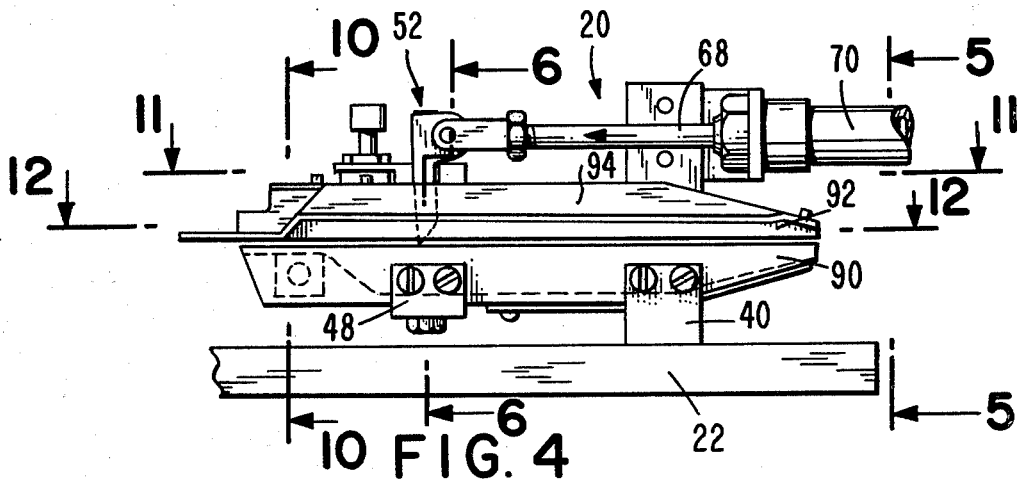
FIG. 4 is an elevational view taken from the left side of a feeding and folding mechanism of the apparatus of FIG. 1, and illustrating the mechanism at an advanced position in the feeding of the slide fastener chain.

As illustrated in FIG. 4 the forward ends 90 and 92 of the respective guide members 42 and 44 are tapered so as to have relatively narrow front ends to be inserted between the respective fly pieces 30 and 32 and the slide fastener chain 26. A first folding member 94 is mounted on the upper member 44 as shown in FIGS. 4, 5, 10 and 11, and extends to the left of the member 44 throughout the length thereof. A second folding member 96 is mounted on the lower guide member 42 and extends to the right of the guide member 42 throughout the length of the member 42. The forward end 98 of the folding member 94 is tapered to come to a point at the forward end 92 of the guide member 44 so as to be inserted underneath the fly piece 32. The outer edge 100 of the guide member 94 extends from the extreme forward point outwardly to the left and rearward along the tapered front portion 98 of the folding member 94 so as to engage the fly piece 32 and fold the fly piece 32 outward, and extends rearward through the remaining portion of the member 94 parallel to the guide members 42 and 44 so as to maintain the fly piece 32 folded outward as shown in FIGS. 5 and 6. Similarly, the folding member 96 has a tapered front portion 102, FIG. 12, with an outer edge 104 extending rearward and outward along the front portion 102 for engaging the fly piece 30 to fold the fly piece 30 downward away from the fastening elements of the slide fastener chain, and the edge 104 extends in the remaining portion of the folding member 96 parallel to the members 42 and 44 so as to maintain the fly piece 30 folded away from the slide fastener chain. Rear portions 106 and 108 of the respective folding members 94 and 96 are bent into a generally horizontal condition so as to substantially flatten the folded fly pieces 32 and 30 as shown in FIG. 10.

Conveniently, a push button control device such as a valve 110, illustrated in FIGS. 1 and 6, is mounted on the bracket 48. This control device is connected to the operating mechanism 24 to trigger the operating mechanism 24 in a conventional manner and is mounted on the bracket 48 so as to be convenient for operation by the operator to initiate cycling of the mechanism 24. A valve 112, FIG. 1, is operated by the mechanism 24 near the end of the cycling of the mechanism to operate the air cylinder 70. If automatic operation of the feeding and folding mechanism 20 is not desired, the air cylinder 70 can be removed and the pawl mechanism 52 can be operated manually.

In operation of the apparatus of FIG. 1, the article 25 is initially inserted into the mechanism 20 by passing the chain with fly pieces sewn thereon in front of the table 22 to the front portion of the mechanism 20. The chain 26 from the supply or box below the table 22 has the single thickness fly piece 30 facing toward the front as the fly piece passes over the edge of the table and is twisted counter clockwise progressing toward the front of the mechanism 20 through 180 degrees so that the fly piece 32 is on top at the entrance to the mechanism 20. This counterclockwise twist rotates the slide fastener chain 26 away from the fly pieces 30 and 32 so that at the entrance to the mechanism 20 the fly pieces 30 and 32 will be spaced from the slide fastener chain 26 as shown in FIG. 3. The slide fastener chain is initially threaded through the mechanism 20 with the slide fastening elements of the slide fastener chain 26 guided in the groove 50. The folding members 94 and 96 fold the respective fly pieces 32 and 30 away from the fastening elements of the slide fastener chain 26 as shown in FIGS. 5, 6, and 10. The leading section of the slide fastener chain with attached fly pieces is positioned in the operating mechanism 24 for being operated thereon. The push button valve 110 is depressed to trigger a first operation of the mechanism 24. At or near the completion of the operation of the mechanism 24, the valve 112 is operated to advance and retract the piston rod 68. During advancement of the piston rod, the pawl 58 pivots about the pin 60 to engage the tip 78 into an interstice between the fastening elements of the slide fastener chain 26. Continued forward movement of the piston rod 68 causes engagement of the pivot pin 74 against the post 72 of the slide block 54 which then slides forward resulting in movement of the slide fastener chain 26 from the front toward the rear of the feeding and folding mechanism 20. During retraction of the piston rod 78 the pawl 58 pivots clockwise as shown in FIG. 8 to raise the tip 78 from the slide fastener chain. Continued movement of the pawl 58 engages the shoulder 76 whereupon the slide block 54 moves rearward to retract the pawl mechanism 52 to its retracted position.

This feeding of the slide fastener chain results in a leading section of the slide fastener chain, with the fly pieces 30 and 32 folded outward, protruding from the rear end of the mechanism 20. This section of the slide fastener chain and fly pieces can be easily grasped by the operator and with a minimum amount of pulling can be positioned in the mechanism 24 for a subsequent operation.

During the feeding of the mechanism 20 and the pulling of the slide fastener chain through the mechanism 20 to position the desired section within the operating mechanism 24, the fly pieces 30 and 32 continue to be engaged by the folding members 94 and 96 to fold the fly pieces 30 and 32 outward away from the fastening elements of the slide fastener chain. Thus the operator does not have to manually fold the fly pieces away from the fastening elements so that the mechanism 24 can gap the slide fastener elements, apply a bottom stop staple, etc., without interference from the fly pieces 30 and 32.

The folding and feeding mechanism provides a substantial reduction in operator effort and fatique since the folding of the fly pieces 30 and 32 is done automatically by the folding members 94 and 96, and the leading end of the next section of the slide fastener chain is fed a position protruding from the mechanism 20 suitable for being easily grasped and moved the necessary distance to position the slide fastener chain in the operating mechanism 24. In prior art guiding or folding mechanisms, no projecting material was left to grasp, necessitating extensive operator effort to grasp the slide fastener chain.

Since the above described embodiment is subject to many modifications, variations and changes in detail, it is intended that all matter described in the foregoing description and shown in the accompanying drawings be interpreted as illustrative and not in a limiting sense.

I claim:

1. An apparatus for feeding a slide fastener chain which has interlocking fastening elements secured on inner edges of respective tapes of a pair of tapes of the slide fastener chain, and for folding an article member secured on an outer edge portion of one of the tapes and extending over the fastening elements of the slide fastener chain, the apparatus comprising an upper elongated guide member, a lower elongated guide member extending parallel to the upper guide member, said upper and lower guide members having channel means forming a feed path therebetween for receiving and guiding the interlocking fastening elements, pawl means slidably mounted on one of the upper and lower guide members for engaging a fastening element of the fastening elements on the slide fastener chain and for moving the slide fastener chain along the feed path, a folding member mounted on one of the upper and lower guide members and having a forward tapered tip disposed adjacent to an entrance end of the upper and lower guide members for engaging the article member on a surface facing the one tape, and said folding member having an outer edge which extends outward and rearward along the tapered tip and parallel to the guide members from the tapered tip rearward to fold and hold the article member away from the fastener elements.

2. An apparatus as claimed in claim 1 wherein the pawl means includes a block slidably mounted along the one guide member, a pawl pivotally mounted on the slide block and having a tip for engaging the slide fastener elements when the pawl is pivoted to a forward position and for disengaging the fastening elements when the pawl is pivoted to a rearward position, and means for limiting forward and rearward movement of the pawl.

3. An apparatus as claimed in claim 2 wherein the means for limiting the rearward and forward movement of the pawl includes a post extending upward from the sliding block for limiting forward movement of the pawl, and a shoulder on the block for engaging the pawl to limit rearward movement of the pawl.

4. An apparatus as claimed in claim 1 wherein the folding member has a rear portion formed substantially horizontal for holding the article member in a flattened horizontal position.

5. An apparatus as claimed in claim 1 including means responsive to operation of an operating mechanism for advancing and retracting the pawl means to feed a section of slide fastener chain through the apparatus.

6. An apparatus as claimed in claims 1, 2, 3, or 4 including a second folding member mounted on the other of the upper and lower guide members for engaging and folding a second article member secured to an outer edge portion of the opposite tape of the slide fastener chain.

* * * * *